United States Patent [19]

Ravotto et al.

[11] 4,121,752

[45] Oct. 24, 1978

[54] SELF-OPENABLE DEVICE AND BLANK THEREFOR

[75] Inventors: Richard Albert Ravotto, Greenbrook Estates, N.J.; Charles Warner Rosenburg, Jr., Tonawanda, N.Y.

[73] Assignees: J. C. Penney Company, Incorporated, New York; F. N. Burt Co., Inc., Buffalo, both of N.Y. ; a part interest to each

[21] Appl. No.: 807,495

[22] Filed: Jun. 17, 1977

[51] Int. Cl.[2] ..... B65D 5/48

[52] U.S. Cl. ..... 229/27; 229/22; 229/15; 206/45.21

[58] Field of Search ..... 229/27, 22, 10, 15, 229/48 SB; 206/45.21, 45.25, 45.26, 45.23

[56] References Cited

U.S. PATENT DOCUMENTS

| | | | |
|---|---|---|---|
| 969,133 | 8/1910 | Cooper | 229/27 |
| 1,680,028 | 8/1928 | Ryan et al. | 229/27 |
| 2,046,484 | 7/1936 | Ringler | 229/27 |
| 2,112,062 | 3/1938 | Berger | 229/27 |
| 2,387,790 | 10/1945 | Williamson | 229/27 |
| 2,640,589 | 6/1953 | Foster et al. | 229/27 |
| 2,711,819 | 6/1955 | Lugt, Jr. | 229/27 |
| 3,301,462 | 1/1967 | Starr | 229/48 SB |
| 3,397,771 | 8/1968 | Fogle | 229/27 |
| 3,880,342 | 4/1975 | Longo, Jr. | 229/27 |
| 3,891,136 | 6/1975 | Woeste | 229/22 |

FOREIGN PATENT DOCUMENTS

| | | | |
|---|---|---|---|
| 230,272 | 3/1963 | Austria | 229/27 |

*Primary Examiner*—William Price
*Assistant Examiner*—Joseph Man-Fu Moy
*Attorney, Agent, or Firm*—Pennie & Edmonds

[57] ABSTRACT

A device for storing and transporting articles embodies a self-openable carton which comprises, in integral combination, a pair of first sidewalls hingedly connected to each other by a hinge crease, a pair of remote folded sidewalls, each one of which is respectively connected to corresponding ones of the first pair of sidewalls, wherein the remote sidewalls have transversely folded reinforcing end tabs. The carton, as envisioned, comprises first and second interior and diagonally arranged retaining walls. Each of the retaining walls is connected to and folded with respect to corresponding ones of the remote sidewalls. Each of the retaining walls may be formed with at least one article receiving compartment, such that whenever in a locked and assembled position each of the diagonal retaining walls is in opposed relation with respect to the other, and whenever in an unlocked position are enabled to automatically move apart from each other to thereby expose articles received within the compartments. End flaps are folded at opposite ends of the retaining walls with folded locking tab means for slidably cooperating with corresponding ones of the reinforcing end tabs to position and support each of the end flaps and the retaining walls to corresponding ones of the remote sidewalls. Connecting strip means are contemplated which are foldably connected to longitudinal edges of the retaining walls and are directly connected to the interior surfaces of corresponding ones of the first pair of sidewalls longitudinally adjacent the hinge crease. Such device comprises locking means operatively cooperating with the self-openable carton which enables the carton to be easily locked and unlocked. Also envisaged is a blank of material which comprises a construction that permits formation of the self-openable carton.

12 Claims, 8 Drawing Figures

SELF-OPENABLE DEVICE AND BLANK THEREFOR

BACKGROUND OF THE INVENTION

1. Field of the Invention

The present invention generally pertains to packages or cartons and the like made from a suitable blank material for packaging a plurality of articles for the purposes of storage and shipment. More specifically, it is directed to a novel and improved reusable compact device comprised of a releasable, self-openable carton arrangement made from a unique unitary blank of material.

2. Description of the Prior Art

Heretofore, numerous packages and cartons for carrying and storing items have been manufactured from corrugated material, fiberboard and other appropriate materials. These packages and cartons have gained wide acceptance in industry. Generally, such packages and cartons of the foregoing type may be constructed to include a plurality of compartments which suitably may receive a large assortment of differently configured and dimensioned articles.

Typically, packages and cartons of this general category include corresponding partition walls which separate and restrain the articles from uncontrolled sliding movement and act to prevent breakage during transit or storage. Ordinarily, such constructions are typified by sidewalls having folded end flaps which are adhesively bonded or stapled to the sidewalls to form a unitary package. Still other constructions have the end flaps formed with locking tabs or partitions which suitably cooperate with the sidewalls of the package in various ways to form openable end flap members.

Disadvantages are associated with the foregoing types of package constructions inasmuch as such kinds often are difficult to immediately open so as to gain convenient access to all the articles being stored. For instance, many end flaps must often be pulled outwardly from a locked condition. Furthermore, once opened, the glued or stapled flaps are typically not intended to be reclosed, especially in an easy and convenient manner. Exemplary of such conventionally constructed prior art containers are depicted in the following U.S. Pat. Nos.: 3,356,281, 3,899,121, 3,190,485 and 3,974,911.

The present invention, however, provides a novel and improved device with a carton which is self-openable and particularly adapted for carrying and storing a plurality of articles, such as pocket camera sets and other similarly shaped and configured articles in a fashion which permits a user to gain quick and easy access to all such stored articles. In addition, the invention is achieved by a simplified and compact structure which is durable in construction, reliable in operation, economical to manufacture and susceptible of easy self-opening and reclosing.

Also, this invention encompasses a suitable blank material particularly adapted for purposes of forming a self-openable carton containing any number of receiving compartments with corresponding openings and partition walls.

SUMMARY OF THE INVENTION

Broadly, in accordance with the principles of the present invention, there is provided a novel and improved device for storing and transporting articles which comprises a self-openable carton having, in integral combination, a pair of first sidewalls hingedly connected to each other by a hinge crease; a pair of remote folded sidewalls, each one of which is respectively connected to corresponding ones of the first pair of sidewalls, wherein the remote sidewalls have transversely folded reinforcing end tabs. This particular carton is envisioned as comprising first and second interior and diagonally arranged retaining walls, wherein each of the retaining walls is connected to and folded with respect to corresponding ones of the remote sidewalls. Each of the retaining walls may be formed with at least one article receiving compartment such that whenever in a locked and assembled position, each of the diagonal retaining walls is in opposed relation with respect to the other and whenever in an unlocked position are enabled to automatically move apart from each other to thereby expose articles received within the compartments. End flaps are folded at opposite ends of the retaining walls with a folded locking tab means for slidably cooperating with corresponding ones of the reinforcing end tabs to position and support each of the end flaps and the retaining walls to corresponding ones of the remote sidewalls. Connecting strip means are embodied which are foldably connected to longitudinal edges of the retaining walls and are directly connected to the interior surfaces of corresponding ones of the first pair of sidewalls longitudinally adjacent the hinge crease. Such device comprises a locking means operatively cooperating with the self-openable carton which enables the carton to be easily locked and unlocked.

In a preferred embodiment, the locking means is defined by a hollow tubular outer sleeve member having opposite open end portions which are arranged to have slidably insertable therein and removable therefrom the self-openable carton. With such embodiment, the carton is arranged such that the retaining walls are positioned in opposed and adjacent relation with each other whenever in the locked position wherein the carton is received within the outer sleeve. Such retaining walls are enabled to automatically and symmetrically separate whenever the tubular outer member and carton are separated from each other to thereby expose the articles carried in the compartments.

Also, the present invention includes a blank of foldable material for forming a self-openable carton. Such blank comprises, in integral combination, a pair of first sidewall panels hingedly connected to each other by a hinge crease, a pair of remote foldable sidewall panels, each one of which is respectively connected to corresponding ones of the first pair of sidewall panels wherein the remote sidewall panels have connected at opposite ends thereof foldable reinforcing end tabs. The blank, as envisioned, comprises first and second interior retaining wall panels, each one being foldably connected to corresponding ones of the remote panels. Each of the retaining wall panels may be formed with at least one article receiving compartment defined by at least one foldable partition wall flap. Such retaining panels also include at opposite ends foldable end flaps having locking tab means which enable slidable cooperation with corresponding ones of the reinforcing end tabs to position and support each of the end flaps and the retaining wall panels to corresponding ones of the remote sidewall panels. Foldable connecting strip means are foldably connected adjacent each retaining wall and are adapted to be directly connected to interior surfaces of corresponding ones of the first pair of sidewall panels longitudinally adjacent the hinge crease.

In a preferred embodiment, the blank includes an intermediate supporting wall foldably connected adjacent to one of the connecting strip means. Such support wall has appropriately formed openings adaptable to receive items storable in a compartment of one of the retaining walls. The foregoing blank advantageously permits the economical formation of the noted self-openable carton.

BRIEF DESCRIPTION OF THE DRAWINGS

The above, as well as other objects, features and advantages of the present invention shall become apparent upon a reading of the detailed description of a compact self-openable device and blank therefor made in accordance with the principles of the present invention when viewed in conjunction with the several drawings wherein like reference numerals represent like structure throughout the several views.

DETAILED DESCRIPTION

Figure 8:
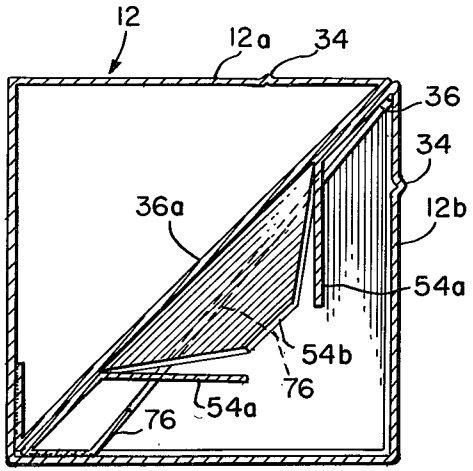
FIG. 8 represents a cross-sectional view taken substantially along section line 8—8 appearing in FIG. 7, looking in the direction of the arrows, and illustrating details of the self-openable carton depicted in the assembled position.

Referring now to the drawings and, in particular, to FIG. 8, there is perhaps more precisely depicted the novel and improved package device of the present invention being identified by reference numeral 10. Such package device 10 is seen to include a self-openable carton member 12 which cooperates with locking means 14.

In the illustrated embodiment, the locking means 14 is depicted as being comprised of a generally elongated, rectangular-shaped, tubular outer case member 16. Case member 16 has open opposite end portions 18. The end portions 18 are adaptable to slidably receive and cooperate with carton member 12, in a manner afterwards made apparent to either lock the latter in the assembled position or enable it to open, thereby exposing the contents stored therein. While this particular embodiment discloses that locking means 14 is comprised of a tubular outer case member 16, other forms of locking devices for facilitating selective closing and opening of the self-openable carton memeber 12 are well within the spirit and scope of the invention. For instance, such locking devices may comprise adhesive strips, or elastomeric members which selectively cooperate with opposed symmetrically movable carton halves **12*a* and 12*b*. However, it has been determined that through use of tubular outer case 16, the self-openable carton 12 can be conveniently, repeatedly, and reliably stored therein, as well as easily withdrawn therefrom for purposes of enabling such carton to be conveniently opened. The outer case member 16 may, of course, have any desired configuration, but one which has a configuration generally complementary to the peripheral configuration of carton member 12 is desirable. Such outer case member 16 may be fabricated from any suitable material, such as fiberboard or the like. Additionally, such outer case member 16 need not have to be of the same axial extent of the carton 12**.

Figure 1:
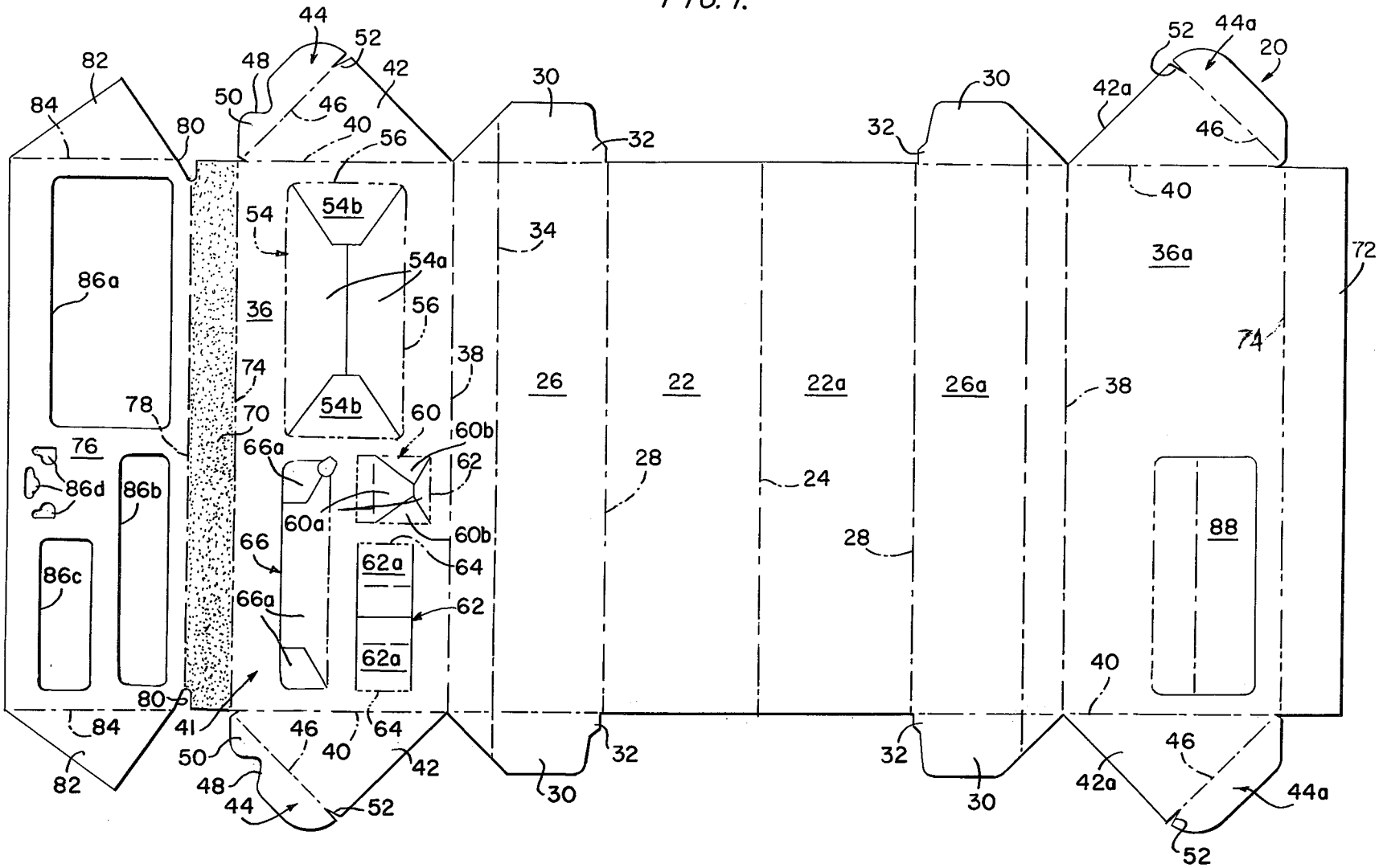
FIG. 1 represents a plan view demonstrating the novel and improved blank which embodies the principles of the present invention and which, whenever assembled in the manner intended, forms the self-openable carton.

Regarding FIG. 1, there is perhaps more clearly depicted a novel and improved blank 20 envisioned by the instant invention for forming the self-openable carton 12. Such blank 20 is a unitary flat member, made of an appropriate foldable material, such as fiberboard or the like. For sake of clarity in understanding the novel construction of FIG. 1, it will be recognized that the dot and dash lines represent creases; the dot, dot and dash lines represent scored lines; the solid lines represent cut portions; and the dash, dash, dot lines represent cut and crease lines.

With continued reference to FIG. 1, there is depicted a first pair of generally rectangular sidewall panels 22 and **22*a* hingedly connected to each other along their common longitudinal edges, by a foldable crease 24, which serves as a generally flexible hinge. Such generally flexible hinge crease 24 enables easy separation of foldable carton halves 12*a* and 12*b*, as afterwards made evident. A second pair of remote generally rectangular sidewalls 26 and 26*a* is illustrated, each of which is foldably connected, by creasable lines 28, to opposite longitudinal edges of corresponding ones of the first pair of sidewalls 22 and 22*a***, respectively.

Located at and foldably connected to each opposite end of the remote sidewalls 26 and **26*a*, as by a creasable connection 29, are reinforcing tab means 30. The tabs 30 serve as reinforcing members to make the carton member 12 more rigid. Each reinforcing tab 30 may have a suitable polygonal shape which includes a guiding and locking ear 32 formed adjacent one edge thereof. The purpose and function of such guiding and locking ears 32 will be subsequently described. Each remote sidewall 26 and 26*a* may be formed with a longitudinally extending crease line 34 for purposes of enhancing strength for the carton 12. As seen in FIG. 8, whenever the carton 12 is assembled, such crease lines 34 will enable such sidewalls to bow slightly outwardly during opening to provide for a more durable construction. In the assembled condition of the carton 12, such reinforcing tabs 30 are folded up generally transversely to the planar surface of the corresponding remote sidewalls 26 and 26*a*. In this regard, see FIGS. 2 to 5**.

Such blank 20 also includes a pair of interiorly arranged retaining walls 36 and **36*a* which are foldably connected, as by foldable crease line connections 38**, to corresponding longitudinal edges of each remote sidewall 26 and 26*a*, respectively. As will be subsequently explained, the retaining walls 36 and 36*a*, whenever in the assembled position, are adapted to be in opposed, parallel and contacting relationship with respect to each other, such as depicted in FIG. 8. Alternatively, the retaining walls 36 and 36*a* are swingable to their outermost and open position for purposes of exposing the contents to be stored therein. In this regard, see FIG. 6. Additionally, as will be explained, each of the retaining walls 36 and 36*a* has formed therein retaining compartment means 41 which serve the purpose of storing various components, such as camera apparatus.

Located at and foldably connected to opposite ends of each of the retaining walls 36 and 36*a*, as by foldable creases 40, are pairs of corresponding end flap members 42 and 42*a*, respectively. Each of the flap members 42 and 42*a* are adapted to be transversely folded with respect to the interior surfaces of retaining walls 36 and 36*a*, such as shown in FIGS. 3 to 6, to form the exposed end wall of carton 12.

With respect to FIG. 1, it will be shown that locking tab means 44 and 44*a* are formed on each of the end flaps 42 and 42*a*, respectively. Locking tabs 44 and 44*a* are adapted to be folded along their corresponding creasable connecting portions 46. In this particular embodiment, the locking tabs 44 and 44*a*, whenever folded, such as along the creasable connecting portions 46, are adapted to cooperate with the reinforcing tab walls 30 to secure and support the end flaps 42 and 42*a*, as well as retaining walls 36 and 36*a* in their intended folded positions, in a fashion afterwards made apparent.

Figure 4:
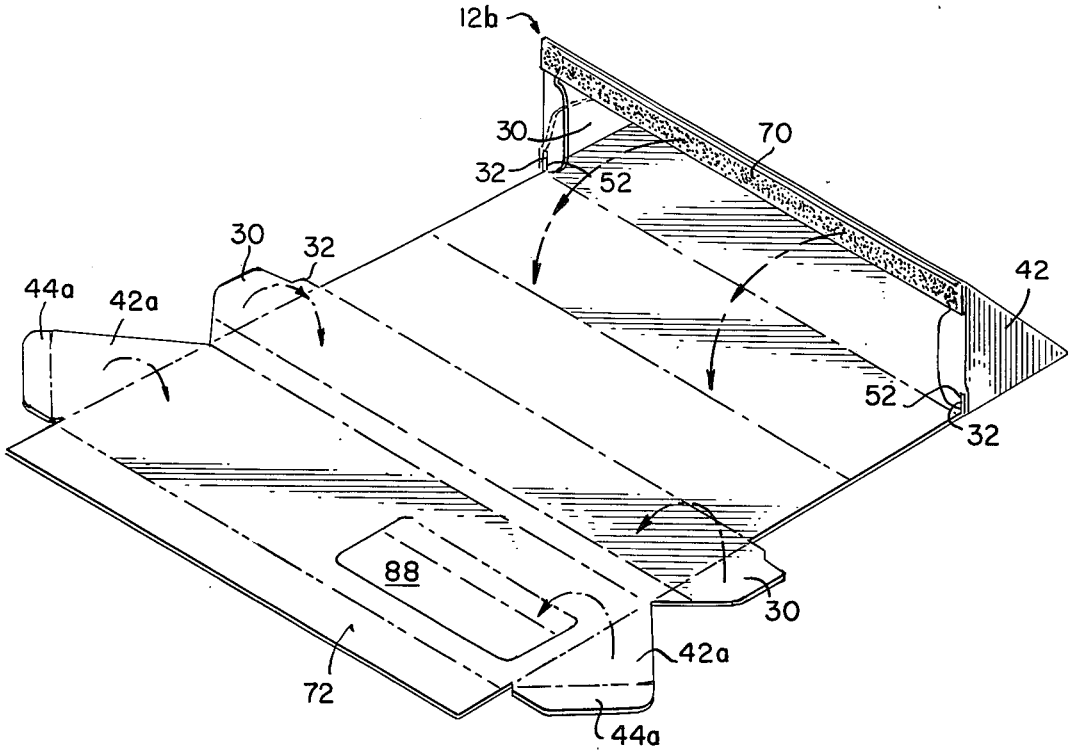
FIG. 4 is a perspective view representing still another step in a sequence of views which illustrate formation and construction of the self-openable carton of this invention.

As best viewed in FIG. 1, the locking tabs 44*a* include a relatively large interlocking recess 48 and an arcuate-shaped locking portion 50. Relatively small guiding and supporting notches 52 are formed at the outer ends of the foldable connections 46. With particular reference to FIG. 4, it will be seen that guiding and supporting notches 52 slidably cooperate with the guiding and locking ears 32 formed along an edge of reinforcing tabs 30. By reason of this particular arrangement, the assembly of the carton 12 is advantageously facilitated since a more stable and secure connection between the end flaps 42 and 42*a* of retaining walls 36 and 36*a*, respectively, with corresponding reinforcing tabs 30 of remote sidewalls 26 and 26*a*, is achievable.

Figure 5:
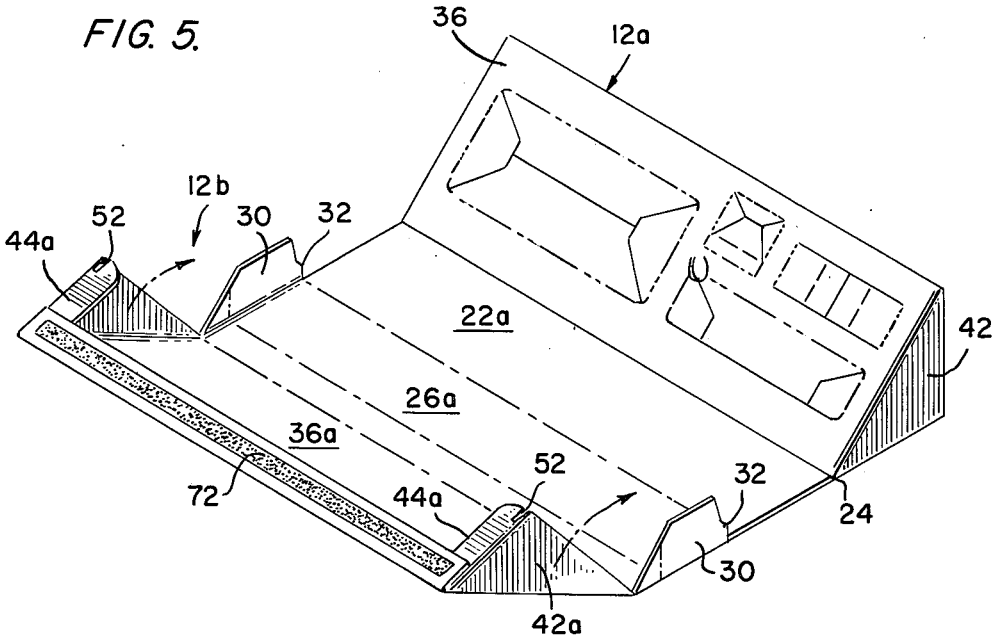
FIG. 5 is a perspective view representing still another step in a sequence of views which illustrate formation and construction of the self-openable carton of this invention.
Figure 7:
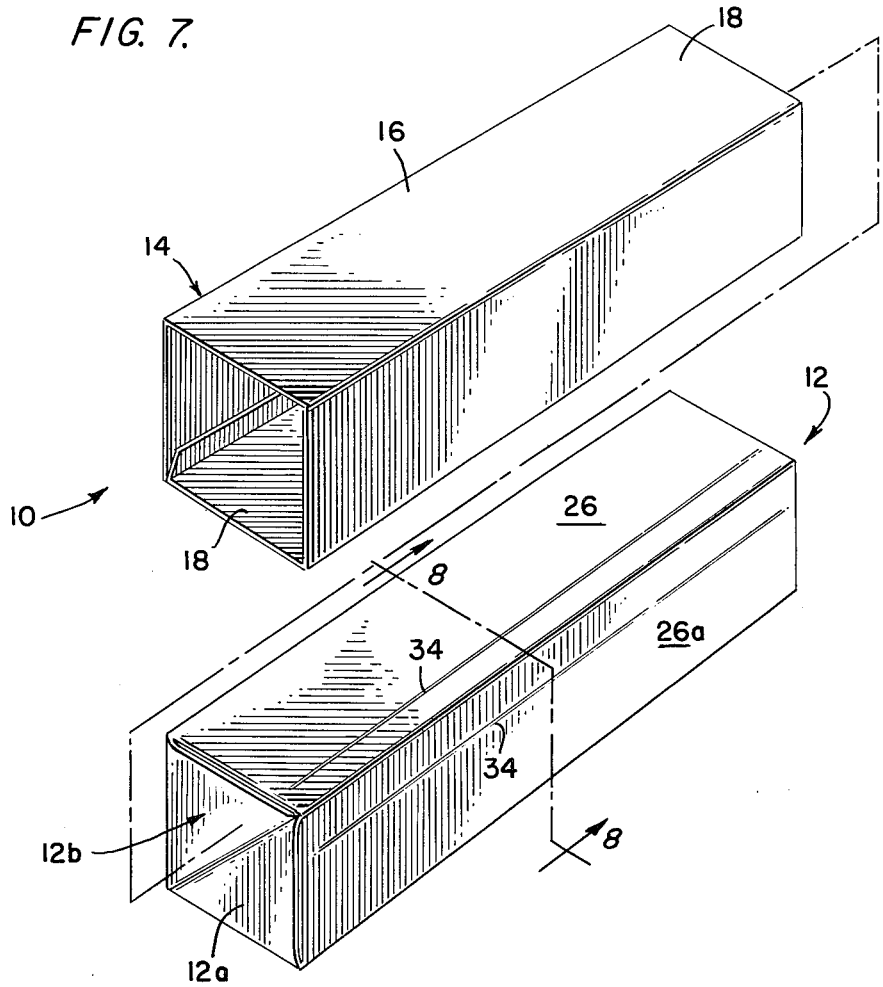
FIG. 7 represents the novel and improved package of the present invention illustrating the self-openable carton in a closed position and adapted to be inserted into an outer tubular locking member.
Figure 6:
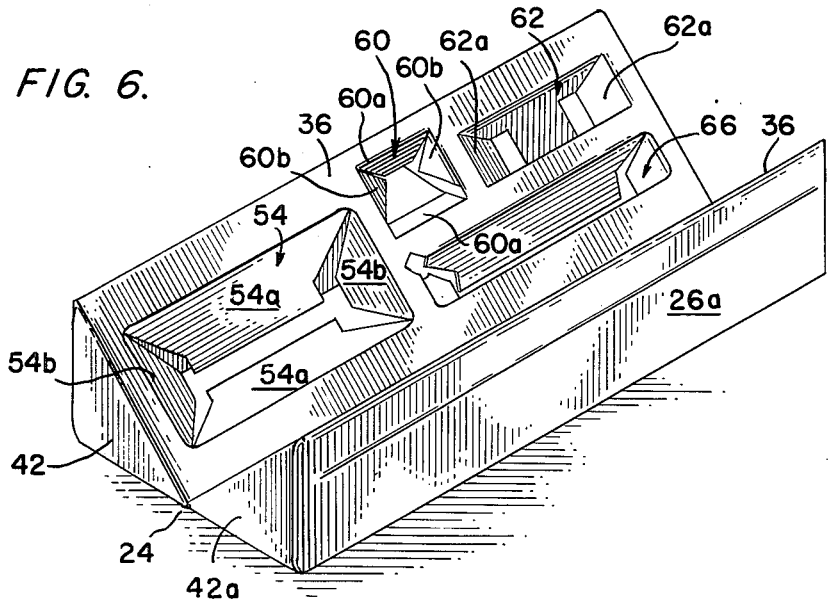
FIG. 6 is a perspective view representing the self-openable carton of the present invention in an assembled and open condition.

Now referring to the compartment means 41, reference is now made to FIGS. 2 through 7 as well as FIG. 1. Interior retaining wall 36 is formed with a plurality of compartments suitably sized and configured to receive articles, such as camera components. As best depicted in FIG. 1, storage compartment 54 is formed of first and second pairs of opposed polygonal-shaped foldable partition wall flaps 54*a* and 54*b*. Each of the flaps 54*a* and 54*b* is independently and foldably connected, by a scored connection line 56, to the main body portion of retaining wall 36. Such partition wall flaps 54*a* and 54*b* are designed to be folded inwardly away from the exposed surface of retaining wall 36, such as illustrated in FIGS. 6 and 8. Partition wall flaps 54*a* and 54*b* may have any desired shape and size and, as illustrated, are polygonal. Whenever in the desired folded position, such partition walls 54*a* and 54*b* serve to enhance containment of an article stored therebetween.

Another storage compartment 60 may be defined by pairs of first and second polygonal-shaped partition wall flaps 60*a* and 60*b*. Each one of the respective pairs of flaps 60*a* and 60*b* may be foldably connected to the main body of the retaining wall 36, as by scored connection lines 62. Similarly, partition flaps 60*a* and 60*b* are adapted to be folded inwardly, away from the surface of such retaining wall 36 to form the recessed storage compartment 60. Partition flaps 60*a* and 60*b* serve to contain the article as by resisting sliding movement of the article to be stored.

Compartment 62 is formed by a pair of opposed foldable retaining partition flaps 62*a*. Each partition flap 62*a* has a transverse foldable connecting portion formed as by scored cut and crease lines or the like. These opposed partition wall flaps 62*a* are similarly intended to be bent along their cut and crease lines and folded inwardly, along their scored line connection 64 from the main body surface of retaining wall 36. Such arrangement conveniently serves to assist in retaining the articles to be stored while preventing undesired shifting.

Compartment 66 may be formed by three separate and independently movably polygonal-shaped retaining partition walls 66*a*. Parition walls 66*a* may be foldably connected, along a scored line connection 68, to the main body of retaining wall 36. Each partition wall 66*a* is folded inwardly, much as in the manner illustrated in FIG. 6 for receiving an article therein.

From the foregoing description of the compartments, it is clear that the present invention envisions that several differently sized and shaped compartments may be fabricated, each having differently dimensioned and configured partition flaps. It is also within the scope of this invention that the retaining walls 36 and 36*a* need not have compartments.

Foldable connecting portions 70 and 72, respectively, are foldably connected as by scored lines 74, to the longitudinal edges of corresponding interior retaining wall 36 and 36*a*. Such connecting portions 70 and 72 in this particular embodiment may be treated with any appropriate layer of adhesive material. The adhesive enables the connecting portions 70 and 72 to be affixed to the first pair of sidewalls 22 and 22*a*, respectively, longitudinally adjacent the foldable hinge 24. Although in the preferred embodiment, the strip portions 70 and 72 are treated with a layer of suitable adhesive bonding material, it will be appreciated that such connecting portions may be fastened to the sidewalls 22 and 22*a*, respectively, by other modes of fastening, such as staples or the like. As will be subsequently made evident, the foregoing described connection adjacent hinge 24 enables carton halves 12*a* and 12*b* to be symmetrically openable and closable in an extremely easy and convenient fashion.

With continued reference to FIG. 1, taken in conjunction with FIGS. 2 through 4 and 8, it will be noted that the preferred blank 20 includes an intermediate supporting wall generally designated by reference numeral 76. Intermediate supporting wall 76 is foldably connected, as by a cut and crease connection 78, to glue strip portion 70. At opposite ends of the cut and crease connection 78, there are formed relatively enlarged interlocking notches 80, as perhaps best depicted in FIG. 1. Notches 80, as best shown in FIG. 4, interengage with the arcuate locking recess 48. In the assembled position, the arcuate locking portion 50 can be easily positioned behind the glue strip portion 72 to provide a compact and secure type of interengagement. By reason of the foregoing arrangement, there is provided an improved support for the end flaps 42 and 42*a*.

Figure 3:
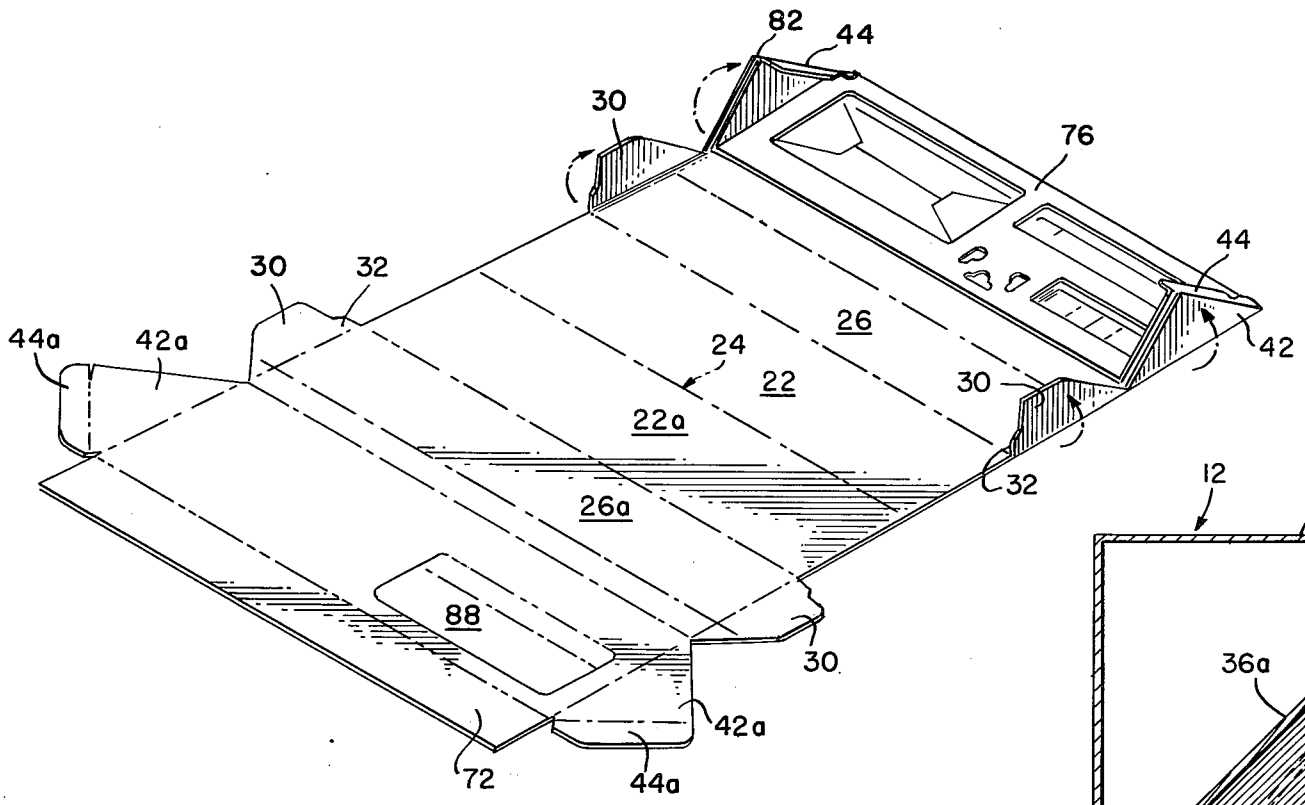
FIG. 3 is a perspective view representing another step in a sequence of views which illustrate formation and construction of the novel and improved self-openable carton embodying the principles of the present invention.

The intermediate wall 76 is also formed with supporting tabs 82 which are situated at and foldably connected, as by cut and crease connections 84, to opposite ends thereof. The end supporting tabs 82 may have a generally flat triangular shape which generally corresponds to the configuration of the end flaps 42 and 42*a* whenever the latter are folded. As perhaps best seen in FIG. 3, the intermediate supporting tabs 82 are, whenever in the assembled position, situated between the reinforcing tabs 30 and the exposed end flaps 42*a*. Such constructional arrangement enhances the strength of the carton 12. As best shown in FIG. 3, tabs 82 have edges 82*a* which are designed to contact the interior surface of the remote sidewall 36. By this arrangement, it will be appreciated that the tabs 82 strengthen the carton halves and by tending to resist collapsibility.

In regard to FIGS. 1 and 8, the intermediate supporting wall 76 is formed with a plurality of cutouts 86*a*, 86*b*, 86*c* and 86*d*. Cutouts 86*a–c* are sized and configured to cooperate with whatever articles are received by corresponding compartments formed in the retaining wall 36. By such cooperation, intermediate supporting wall 76 enhances the retaining and supporting function for the articles which are to be stored by the carton. Cutouts 86*d* are formed by a plurality of spaced openings which may be sized, configured and arranged to cooperate with the flaps 60*a* and 60*b* of compartment 60 formed in retaining wall 36 whenever in the assembled position. For example, a flash cube or other similarly shaped article may be stored in such compartment. It will be appreciated that the foregoing intermediate supporting wall 76 facilitates retention of the articles in the various compartments and that supporting tabs 82 enhance overall strength of the ends of the carton 12. Also, retaining wall 36*a* has a foldable wall 88 which cooperates with the articles to be stored.

After having explained the foregoing blank structure, it is believed the construction of the self-openable carton 12 is well known. However, a brief sequence of views showing a particular mode of assembly of the carton 12 will be presented for purposes of more clearly demonstrating the construction thereof.

Figure 2:
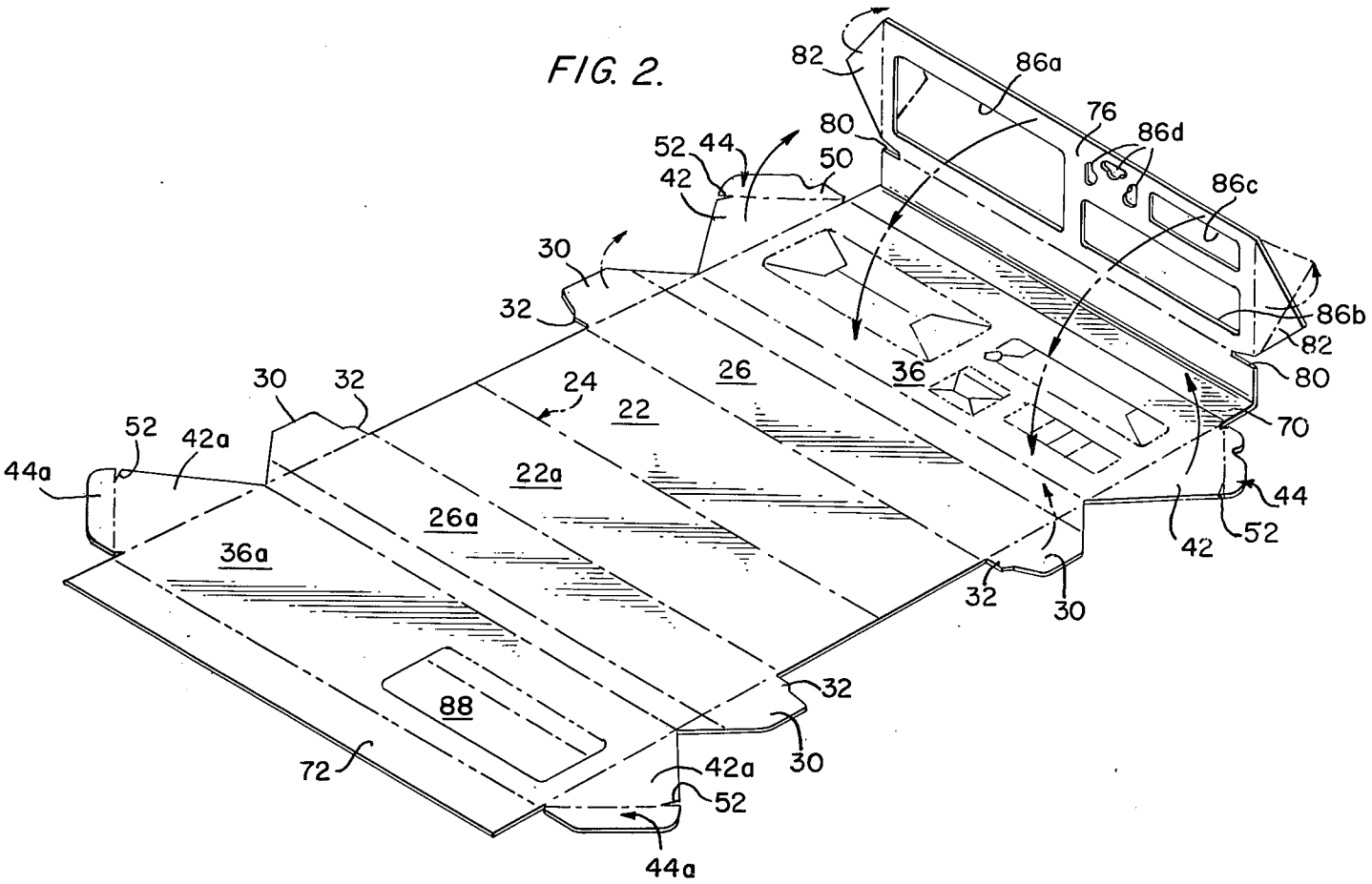
FIG. 2 is a perspective view representing one step in a sequence of views illustrating the construction and arrangement of details of the blank being folded.

As shown in FIGS. 2 and 3, the intermediate supporting wall 76 with corresponding interconnecting glue strip portion 70 may be folded, as indicated by the arrows along scored line 74. Additionally, the intermediate supporting tabs 82 are transversely folded along their respective cut and crease connections 84, in the direction of the arrows, to the noted full line position in FIG. 3. Thus, whenever the intermediate supporting wall 76 is positioned in an overlying relation with respect to an interior surface of retaining wall member 36, such as shown in FIG. 3, the supporting end tabs 82 will be folded upwardly. Both end flaps 42*a* and reinforcing tabs 30 are similarly transversely folded upwardly along their respective creasable connections, as indicated in FIG. 3 by the arrows. It will be noted that the locking tabs 44 are also transversely folded along creasable connecting portions 46. In this situation, tabs 44 overlie corresponding ones of the upstanding edges of the intermediate supporting tab 82.

Turning to FIG. 4, the arcuate tab portion 50 of tab locking means 44 will be shown to fit behind the adhesively bonded surface of strip portion 70. To facilitate such a fitting engagement, there is a corresponding interengagement between notches 48 and 80. By reason of the constructional interengagement illustrated in FIG. 4, there is provided a more rigid structural arrangement for the carton half 12*b*. To secure carton half 12*b*, to the retaining wall 36, the latter is, of course, rotated about hinge crease 24. Whenever this occurs, the guiding and locking ears 32 will snugly and slidably cooperate with the interlocking notches or recesses 52 to thereby enhance an easy and more secure connection between intermediate supporting wall 76 and retaining wall 36 with respect to the individual sidewalls 22.

In connection with the construction of the other carton half 12*a*, it will be seen from FIGS. 4 and 5 that both pairs of reinforcing tabs 30 and end tabs 42*a* are to be transversely folded along their respective creasable connections to assume the upright position in FIG. 5. Additionally, opposed locking tab portions 44*a* are transversely folded relatively inwardly, such that whenever the glue strip connecting portion 72 is folded upwardly along its scored line 74, the adhesive surface will be exposed, as shown in FIG. 5. The opposite surface of connection portion 72 will contact locking tabs 44*a*. It will be further understood with reference to FIG. 5, that the retaining wall 36*a* will be folded along creasable line 38 until notch 52 interengages with the projecting ears 32 on the reinforcing flaps much in the same manner as previously described in connection with foldable tabs 44*a*. The illustrated positioning of the components forming carton half 12*a* strengthens the construction as well as facilitates an easy formation of the carton whenever the latter is assembled. Of course, the connecting portion 72 is brought into contact with the interior surface of retaining wall 22*a* along the longitudinal extent of the hinge crease 24. As a consequence thereof, the foldable carton half 12*a* is formed.

From the foregoing description, it will be apparent that the present invention is defined by a simple and economically constructed package device comprising a carton member that is susceptible of easy opening and closing, whereby the symmetrically disposed carton halves need only be separated to thereby expose all the contents stored. Owing to the hinge crease and the diagonally arranged retaining walls, as well as other arrangements of the components forming the storage carton, such carton is enabled to be self-openable. The closing of the carton is readily facilitated by merely forcing the symmetrically closeable carton halves together and easily sliding it into the tubular locking case. Moreover, the partition flaps of the compartment including intermediate supporting walls serve to provide a suitable compartment for the stored components which also tends to prevent uncontrolled shifting movement of such components. In addition, the supporting walls have end flaps which enhance strength of the carton by serving to resist collapsing.

While the invention has been described in connection with the preferred embodiment, it is not intended to limit the invention to the particular form set forth above, but, on the contrary, it is intended to cover such alternatives, modifications, and equivalents as may be included within the spirit and scope of the invention as defined by the appended claims.

What is claimed is:

1. A blank of foldable material for forming a self-openable carton, which comprises in integral combination, a pair of first sidewall panels hingedly connected to each other by a hinge crease; a pair of remote foldable sidewall panels, each one of which is respectively connected to corresponding ones of said first pair of sidewall panels wherein said remote sidewall panels have connected at opposite ends thereof foldable reinforcing end tabs; first and second interior retaining wall panels, each one being foldably connected to corresponding ones of said remote panels, at least one of said retaining wall panels being formed with at least one article receiving compartment; said retaining panels also including at opposite ends thereof foldable end flaps having locking tab means which enable slidable cooperation with corresponding ones of said reinforcing end tabs to position and support each of said end flaps and said retaining wall panels to corresponding ones of said remote sidewall panels, foldable connecting strip means foldably connected adjacent each of said retaining walls and being adapted to be directly connected to interior surfaces of corresponding ones of said first pair of sidewall panels longitudinally adjacent said hinge crease, and an intermediate supporting wall foldably connected adjacent one of the connecting strip means and having at least an appropriately formed opening alignable with the compartment of one of said retaining walls to facilitate retention of the storable item through the opening in the compartment, said intermediate supporting wall having foldable supporting end flaps configurated and dimensioned such that whenever the carton is in the assembled condition the supporting end flaps enhance the strength and rigidity of a carton which is formed by being positionable between one of the retaining walls and corresponding ones of said end flaps.

2. The blank as set forth in claim 1 wherein each of said locking tab means includes a recessed portion and an arcuate portion wherein said arcuate portion is positioned such that whenever assembled in a carton is situated behind the foldable connecting strips and at least a pair of said locking tab means being formed such that the said recessed portions are adapted to interlock with corresponding the recesses formed along opposite ends of a foldable connection between the folded strip and the associated retaining wall.

3. The blank as set forth in claim 2 wherein each of said reinforcing tabs has a locking ear along one edge thereof, and each of said end flap locking means has a notch which is adapted to slidably cooperate with corresponding ones of said locking ears for guiding and securing each of said end flaps to corresponding ones of said reinforcing tabs such that a secure and strengthened arrangement is formed whenever the blank is assembled to form a carton.

4. A device for storing and transporting articles comprises a self-openable carton which, in integral combination, includes a pair of first sidewalls hingedly connected to each other by a hinge crease, a pair of remote folded sidewalls, each one of which is respectively connected to corresponding ones of said first pair of sidewalls, wherein said remote sidewalls have transversely folded reinforcing end tabs; first and second interior and diagonally arranged retaining walls, each of said retaining walls being connected to and folded with respect to corresponding ones of said remote sidewalls, at least one of said retaining walls being formed with an article receiving compartment, such that whenever in a locked and assembled position each of said diagonal retaining walls is in opposed relation with respect to the other, and whenever in an unlocked position are enabled to automatically move apart from each other to thereby expose articles received within said compartment; end flaps are folded at opposite ends of said retaining walls with folded locking tab means for slidably cooperating with corresponding ones of said reinforcing end tabs to position and support each of the end flaps and the retaining walls to corresponding ones of the remote sidewalls; connecting strip means are foldably connected to longitudinal edges of said retaining walls and are directly connected to interior surfaces of corresponding ones of said first pair of sidewalls longitudinally adjacent said hinge crease; an intermediate supporting wall is positionable behind said one retaining wall with said compartment and has opposed supporting flaps, said opposed supporting flaps have one surface which contacts a corresponding one of said remote sidewalls such that the position of said supporting flap serves to support said one retaining wall and said end flaps for receiving the article to be stored such that the article is restrained; locking means operatively cooperating with the self-openable carton for enabling easy locking and unlocking.

5. The device as set forth in claim 4 wherein said locking means is defined by a generally elongated hollow member having at least one open end which is configured and adapted to slidably cooperate with the exterior surface of said carton whenever the latter is in the assembled position.

6. The device as set forth in claim 4 wherein each of said reinforcing tabs has a locking ear along one edge thereof, each of said end flap locking means having a recess which slidably cooperates with corresponding ones of said locking ears for guiding and securing each of said end flaps to corresponding ones of said reinforcing tabs such that a secure and strengthened arrangement is formed.

7. A device for storing and transporting articles comprises a self-openable carton which, in integral combination, includes a pair of first sidewalls hingedly connected to each other by a hinge crease, a pair of remote folded sidewalls, each one of which is respectively connected to corresponding ones of said first pair of sidewalls, wherein said remote sidewalls have transversely folded reinforcing end tabs and a longitudinally extending crease which strengthens the carton; first and second interior and diagonally arranged retaining walls, each of said retaining walls being connected to and folded with respect to corresponding ones of said remote sidewalls, at least one of said retaining walls being formed with an article receiving compartment, such that whenever in a locked and assembled position each of said diagonal retaining walls is in opposed relation with respect to the other, and whenever in an unlocked position are enabled to automatically move apart from each other to thereby expose articles received within said compartment; end flaps are folded at opposite ends of said retaining walls with folded locking tab means for slidably cooperating with corresponding ones of said reinforcing end tabs to position and support each of the end flaps and the retaining walls to corresponding ones of the remote sidewalls, each of said locking tab means includes a recessed portion and an arcuate portion wherein said arcuate portion is situated behind said folded strip and at least a pair of said locking tab means with each one thereof haing said recessed portions interlocking with corresponding recesses formed along opposite ends of a foldable connection between said folded strip and the associated retaining wall; connecting strips are foldably connected to longitudinal edges of said retaining walls and are adhesively bonded to interior surfaces of corresponding ones of said first pair of sidewalls longitudinally adjacent said hinge crease; an intermediate supporting wall is positionable behind said one retaining wall with said compartment and has opposed supporting flaps, said opposed supporting flaps have one surface which contacts a corresponding one of said remote sidewalls such that the position of said supporting flap serves to support said one retaining wall and said end flaps for receiving the article to be stored such that the article is restrained; locking means operatively cooperating with the self-openable carton for enabling easy locking and unlocking wherein said locking means is comprised of a generally elongated hollow member having opposed open ends which are configured and adapted to slidably cooperate with the exterior surface of the carton.

8. A device for storing and transporting articles comprising:

(A) a self-openable carton having in integral combination, (a) a pair of first sidewalls hingedly connected to each other by a hinge crease, (b) a pair of remote folded sidewalls, each one of which is respectively connected to corresponding ones of said first pair of sidewalls, wherein said remote sidewalls have transversely folded reinforcing end tabs;

(c) first and second interior and diagonally arranged retaining walls, each of said retaining walls being connected to and folded with respect to corresponding ones of said remote sidewalls, at least one of said retaining walls being formed with an article receiving compartment, such that whenever in a locked and assembled position each of said diagonal retaining walls is in opposed relation with respect to the other, and whenever in an unlocked position are enabled to automatically move apart from each other to thereby expose articles received within said compartment;

(d) end flaps are folded at opposite ends of said retaining walls with folded locking tab means for slidably cooperating with corresponding ones of said reinforcing end tabs for positioning and supporting each of the end flaps and the retaining walls to corresponding ones of the remote sidewalls;

(e) connecting strip means are foldably connected to longitudinal edges of said retaining walls and are directly connected to interior surfaces of corresponding ones of said first pair of sidewalls longitudinally adjacent said hinge crease;

(f) an intermediate supporting wall folded relative to and positioned behind one of said retaining walls and having opposed folded supporting flaps positioned between said one retaining wall and one of said end flaps;

(g) said opposing supporting flaps having one surface contacting a corresponding one of said remote sidewalls, said intermediate supporting wall being spaced from said one retaining wall and having an opening therein generally corresponding to the opening in said retaining wall for receiving and supporting an article to be stored such that the article is restrained from uncontrolled sliding or shifting; and (B) locking means operatively cooperating with the self-openable carton for enabling easy locking and unlocking, said locking means being defined by a generally elongated hollow member having at least one open end which is disposed for slidably cooperating with the exterior surface of said carton whenever the latter is in the assembled position.

9. The device as set forth in claim 8 wherein each of said reinforcing tabs has a locking ear along one edge thereof, each of said end flap locking means having a recess which slidably cooperates with corresponding ones of said locking ears for guiding and securing each of said end flaps to corresponding ones of said reinforcing tabs such that a secure and strengthened arrangement is formed.

10. The device as set forth in claim 9 wherein each of said connecting means includes a folded strip which is adhesively bonded to the interior surface of corresponding ones of said first pair of sidewalls.

11. The device as set forth in claim 10 wherein each of said locking tab means includes a recessed portion and an arcuate portion wherein said arcuate portion is situated behind said folded strip and at least a pair of said locking tab means with each one thereof having said recessed portions interlocking with corresponding recesses formed along opposite ends of a foldable connection between said folded strip and the associated retaining wall.

12. The device as set forth in claim 11 wherein each of said remote sidewalls has a longitudinally extending crease which strengthens the carton.

* * * * *

UNITED STATES PATENT AND TRADEMARK OFFICE

CERTIFICATE OF CORRECTION

PATENT NO. : 4,121,752

DATED : October 24, 1978

INVENTOR(S) : Richard Albert Ravotto and Charles Warner

It is certified that error appears in the above-identified patent and that said Letters Patent are hereby corrected as shown below:

Column 4, line 5, "memeber" should be --member--

Column 10, line 57 (Claim 7) "haing" should be --having--.

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*